US006203299B1

(12) United States Patent
Williams et al.

(10) Patent No.: US 6,203,299 B1
(45) Date of Patent: Mar. 20, 2001

(54) CAPACITY MODULATION FOR SCROLL COMPRESSORS

(75) Inventors: John R. Williams, Bristol, VA (US); Gene Michael Fields, Arkadelphia, AR (US); Joe T. Hill; Tracy Milliff, both of Bristol, VA (US); Terry L. Lyons, Bluff City, TN (US)

(73) Assignee: Scroll Technologies, Arkadelphia, AR (US)

( * ) Notice: Subject to any disclaimer, the term of this patent is extended or adjusted under 35 U.S.C. 154(b) by 0 days.

(21) Appl. No.: 09/216,997

(22) Filed: Dec. 21, 1998

(51) Int. Cl.[7] ..... F03C 2/00

(52) U.S. Cl. ..... 418/55.4; 418/55.1; 418/55.2; 418/55.5; 418/57

(58) Field of Search ..... 418/55.5, 57, 55.2, 418/55.1, 55.4

(56) References Cited

U.S. PATENT DOCUMENTS 4,431,388 * 2/1984 Eber et al. ..... 418/55.1
4,696,627 * 9/1987 Asano et al. ..... 418/55.1
5,256,044 * 10/1993 Nieter et al. ..... 418/55.5
5,447,420 * 9/1995 Caillat et al. ..... 418/55.5
5,645,408 * 7/1997 Fujio et al. ..... 418/55.4

FOREIGN PATENT DOCUMENTS

0249684 * 12/1985 (JP) ..... 418/55.5
0106388 * 5/1988 (JP) ..... 418/55.5
0294584 * 12/1990 (JP) ..... 418/55.5
403172592 * 7/1991 (JP) ..... 418/55.5
405149270 * 6/1993 (JP) ..... 418/55.5

* cited by examiner

*Primary Examiner*—Thomas Denion
*Assistant Examiner*—Theresa Trieu
(74) *Attorney, Agent, or Firm*—Carlson, Gaskey & Olds

(57) ABSTRACT

A scroll compressor is provided with structure that allows a reduction or modulation in mass flow capacity. Structure is provided for controlling the back pressure force tending to bias one scroll into other. This structure defines two distinct back pressure chambers. Pressure fluid is not supplied to at least one of the back pressure chambers during modulated operation.

17 Claims, 3 Drawing Sheets

CAPACITY MODULATION FOR SCROLL COMPRESSORS

BACKGROUND OF THE INVENTION

This invention relates to a scroll compressor wherein the volume of the compressor may be changed upon system demand, and wherein the back pressure force is also adjusted.

Scroll compressors provide efficient compression of the refrigerant and thus are becoming popular. On the other hand, scroll compressors do present many design challenges.

Essentially, scroll compressors are formed of two interfitting generally spiral wraps, with one of the wraps orbiting relative to the other. Compression chambers are formed on inner and outer surfaces of the wraps, and close during the orbiting movement of the orbiting scroll member. The compression chambers decrease in size as the orbiting scroll continues its orbital movement, and the refrigerant is compressed.

One challenge with the design of a scroll compressor is providing the ability to vary the output mass of the scroll compressor. This "modulation" of the output volume is desirable for many refrigerant compression applications. In general, proposed modulation schemes to date have concentrated on the mass changes.

However, with mass changes other aspects of the compressor need to be adjusted. In particular, scroll compressors often rely upon a back pressure force from a compressed gas delivered to a rear face of one of the scroll members. The purpose of the back pressure force is to resist a separating force generated from the entrapped fluid between the scroll members. However, with mass changes, the necessary back pressure force also changes. The prior art has not addressed this issue.

SUMMARY OF THE INVENTION

In a disclosed embodiment of this invention, the back pressure chamber provided to maintain the scroll wraps in contact is controlled depending upon whether the compression chambers are modulated. When the mass of gas being compressed is reduced, a separating force tending to separate the fixed and orbiting scrolls is also reduced. As known, scroll compressors are provided with a back pressure chamber wherein a portion of the compressed fluid is tapped to provide a force in opposition to the separating force.

The present invention discloses an embodiment for controlling the amount of gas in the back pressure chamber to in turn control the back pressure force such that when the capacity is reduced, the force in the back pressure chamber is also reduced. In one embodiment this is achieved by providing two distinct back pressure chambers. In a first embodiment a vane blocks flow to one of the two chambers when the volume is reduced. In this way, the back pressure force is reduced to accommodate the reduced separating force from the compression chambers.

In a second embodiment, a separate tap leads from certain of the compression chambers to each of the two back pressure chambers. Thus, when certain of the compression chambers are not provided with compressed fluid pressurized fluid is not tapped into its back pressure chamber. Thus, there will be no force from the non-compression chambers. The back pressure force is correspondingly thus reduced whenever the mass of the scroll compressor is reduced.

In a disclosed embodiment of this invention, modulation is achieved by a modulation member selectively biased to a restriction position wherein it blocks flow of suction fluid to at least some compression chambers between the orbiting and non-orbiting scroll wraps. In a preferred embodiment, the restriction member completely blocks flow to certain of the chambers. It should be understood that the invention could be incorporated into other modulation schemes.

These and other features of the present invention can be best understood from the following specification and drawings, the Following of which is a brief description.

DETAILED DESCRIPTION OF A PREFERRED EMBODIMENT

A disclosed way of achieving modulated operation will be discussed and illustrated. The main aspect of this invention is the modification of the back pressure force, however, and not any particular way of achieving modulated operation. Thus, the invention should not be seen as being limited to the particular modulation scheme.

Figure 1A:
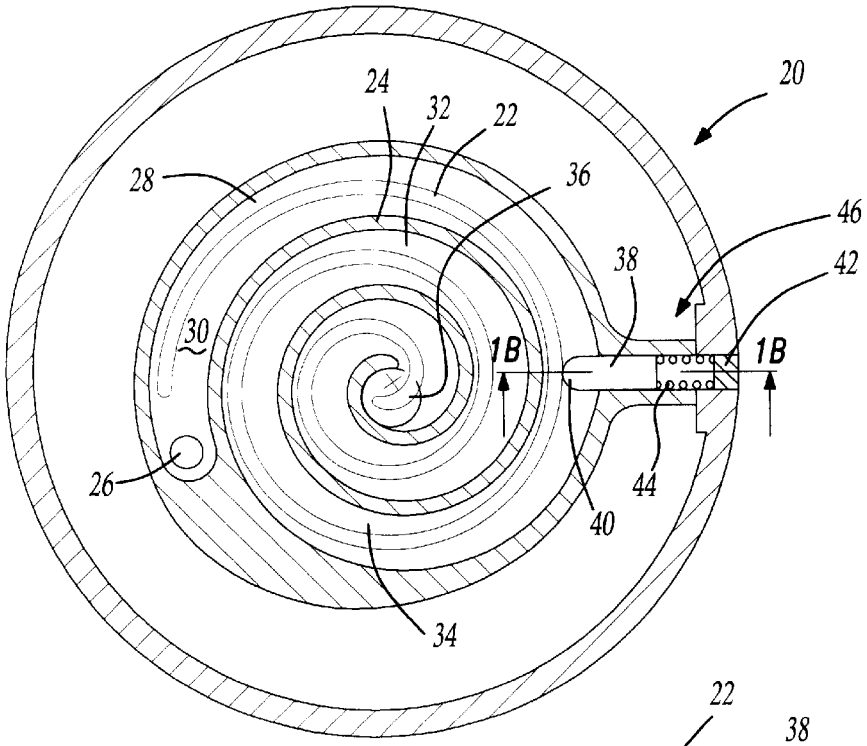
FIG. 1A shows a scroll compressor in a modulated operational state.

FIG. 1A shows a scroll compressor 20 incorporating wrap 22 orbiting relative to a non-orbiting wrap 24. A suction inlet 26 supplies refrigerant to be compressed between the wraps 22 and 24. As known, orbiting wrap 22 is driven for orbital movement relative to the non-orbiting wrap 24. A first compression fluid entrance 28 is formed on an outer face of the orbiting wrap 22 and a second entrance 30 is formed on an inner face of the wrap 22. Suction fluid passes from suction inlet 26 through entrances 28 and 30, and into compression chambers. The compression chambers are eventually sealed at a downstream location, as known. Thus, compression chambers such as chamber 32 are formed on an outer face of the scroll wrap and compression chambers, such as chamber 34 are formed on an inner face of the scroll wrap. Wrap 22 orbits and the compression chambers 32 and 34, and other chambers, are continuously reduced in volume until they communicate with discharge outlet 36.

Thus, there are two sets of compression chambers, inwardly and outwardly of the orbiting scroll wrap 22 which are continuously being compressed. The present invention modulates compressor mass, or capacity, by operating a control 38 to restrict fluid from entering at least certain of the chambers. As shown, in one embodiment a vane 40 contacts an outer face of orbiting wrap 22 to block flow to the outer chambers such as chamber 32. In the illustrated embodiment, a solenoid valve 42 may be actuated to retract vane 40. In the absence of actuation force from the solenoid 42, a spring 44 maintains the vane 40 in contact with an outer face of wrap 22.

Figure 1B:
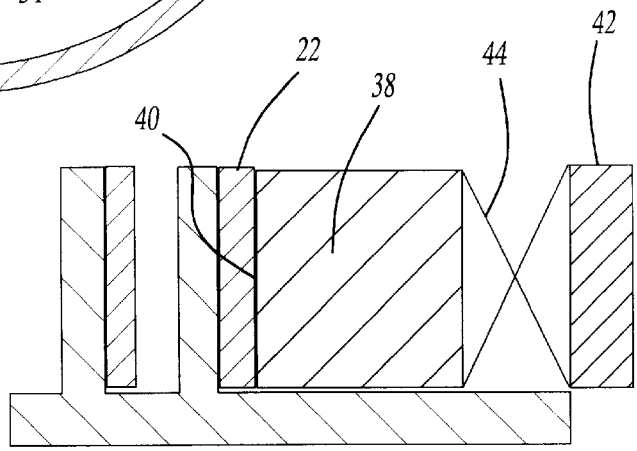
FIG. 1B is a cross-sectional view through line 1B—1B as shown in FIG. 1A.

As shown in FIG. 1B, vane 40 is in contact with the outer face of the wrap 22. Flow from suction port 26 can only flow into the compression chambers through the entrance 30, such as compression chamber 34 on the inner face of wrap 22. Flow is blocked from reaching chambers such as chamber 32.

Preferably, a breather tap is defined to supply fluid flow at a low pressure into the chambers 32 such that there is no vacuum, unwanted noise, or other challenges due to the absence of refrigerant in chambers 32.

When vane 40 is moved to its modulated or restricted position such as shown in FIG. 1A, the mass flow of the scroll compressor 20 is effectively halved. During operation of the scroll compressor 20, there are times when it is desirable to reduce the compression mass flow. The present invention provides an easy method of achieving such modulated operation.

Figure 2:
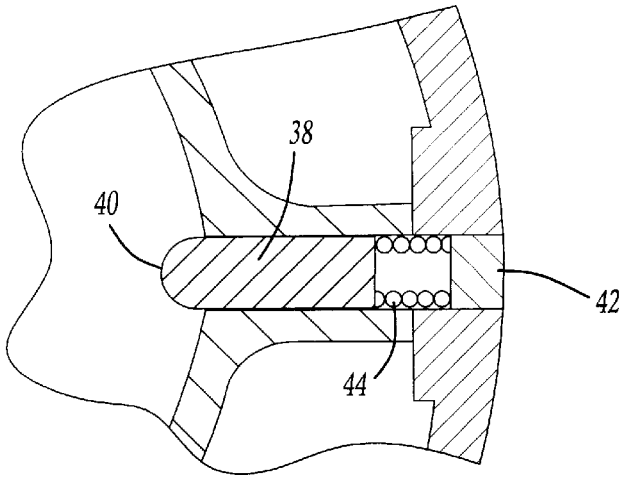
FIG. 2 shows a portion of the FIG. 1A compressor in a non-modulated state.

When full capacity operation is desired, solenoid 42 is actuated and vane 40 is moved against the force of spring 44 to a retracted position 46, such as shown in FIG. 2. Refrigerant can flow through both entrances 28 and 30 to chambers 32 and 34, and full capacity is achieved.

The present invention is shown in one form only. Other restriction structures may be utilized.

When modulated operation occurs, the separating force from the entrapped fluid between the orbiting and non-orbiting wraps is also reduced. The separating force is a force from the entrapped gas volume which tends to force the orbiting and non-orbiting scroll wraps away from each other. Typically, scroll compressor designers provide a back pressure chamber wherein pressurized fluid is tapped to provide a force in opposition to the separating force. During modulated operation, the amount of entrapped gas between the orbiting and non-orbiting scroll wraps may be greatly reduced. Consequently, the back pressure force necessary is also reduced. Typically, the prior art does not adequately reduce the back pressure force during modulated operation.

Figure 3:
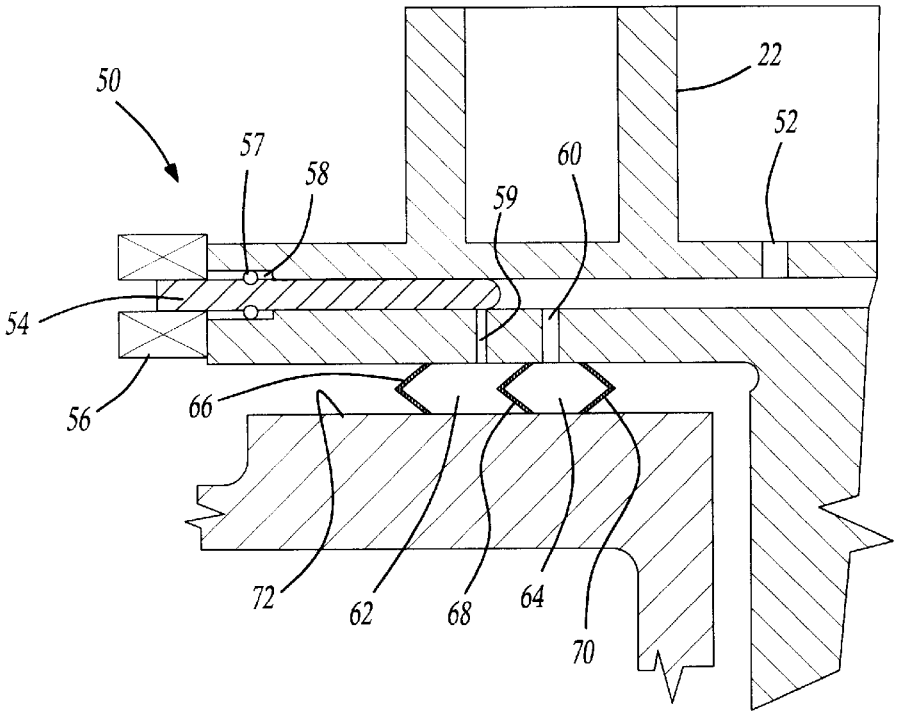
FIG. 3 shows first embodiment back pressure chambers in a modulated state.

As shown in FIG. 3, a system 50 for achieving a variable back pressure force includes a tap 52 for supplying a pressurized fluid to a back pressure chamber. Vane 54 is actuated such as by a solenoid 56 to be in a restricted or a non-restricted position. Vane 54 is shown in the restricted position in FIG. 3. Seal 57 is mounted on the vane 54, and is moveable within a chamber 58 between the restricted and non-restricted positions. As shown in the FIG. 3 position, vane 54 blocks tap 59, while leaving tap 60 open. A series of generally annular seals 66, 68 and 70 define annular chambers 62 and 64. Since chamber 64 is positioned radially inwardly of chamber 62 it may be smaller.

When the compressor 20 is operated in modulated or reduced mass flow operation, vane 54 is moved to the position shown in FIG. 3. Pressurized fluid may pass through tap 52, and through tap 60 into chamber 64. However, pressurized fluid will not pass through tap 59 into chamber 62. Thus, the back pressure force in resistance to the separating force is reduced due to the reduced capacity of the compressor 20.

Figure 4:
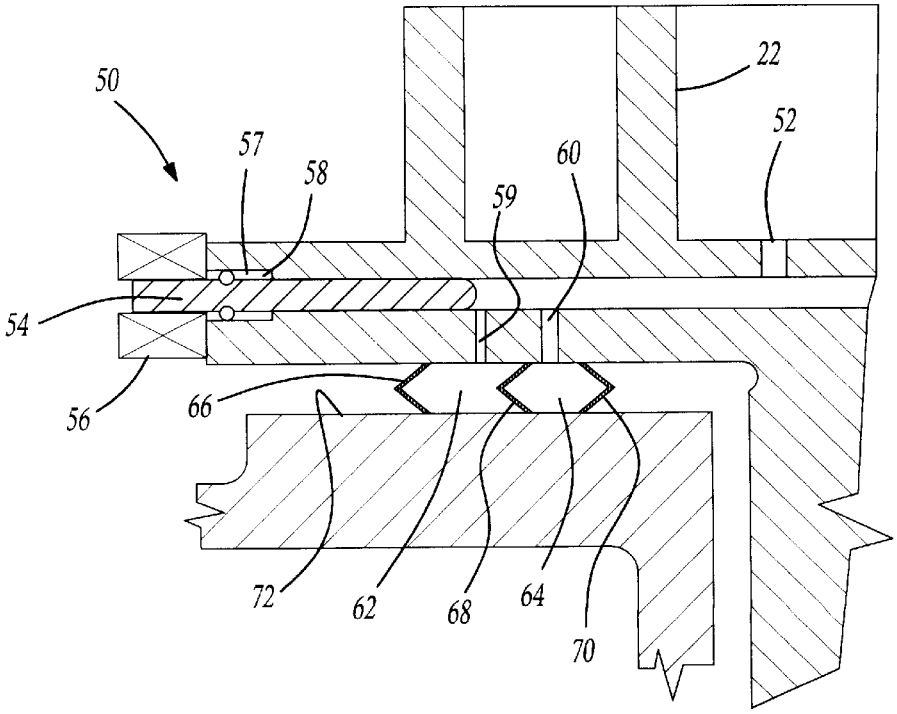
FIG. 4 shows the chambers of FIG. 3 in a non-modulated state.

FIG. 4 shows the system 50 when the compressor is operating at full capacity. The solenoid 56 is actuated to withdraw vane 54, and the tap 59 is opened. It should be understood that a spring or other bias force can be utilized to control the movement of vane 54 between the FIG. 3 and FIG. 4 positions. A worker of ordinary skill in the art would be able to design an appropriate system.

With vane 54 in the FIG. 4 position, fluid can pass from tap 52 into both taps 59 and 60, and hence into both chambers 62 and 64. Now, the back pressure force resisting the separating force is relatively great compared to the FIG. 3 state.

The chambers 62 and 64 are defined between a rear face of the orbiting scroll 22 and a base 72 of the crankcase. Alternatively, it should be understood that the back pressure chambers may also be formed behind the non-orbiting scroll.

Figure 5:
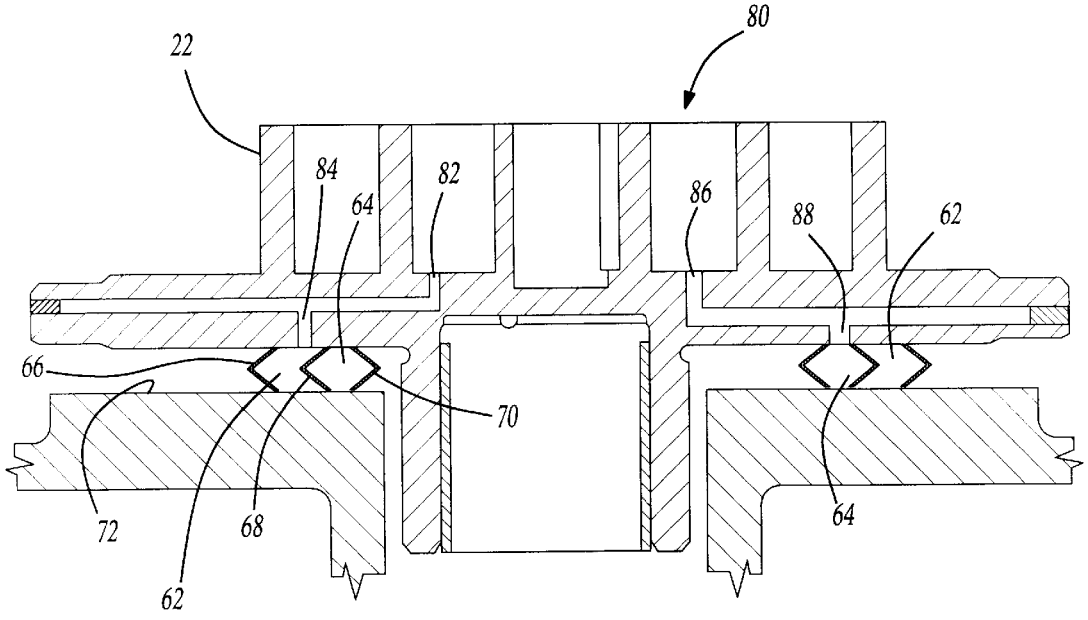
FIG. 5 shows second embodiment back pressure chambers.

FIG. 5 shows a second embodiment 80. In second embodiment 80 tap 82 leads to a second tap 84 directed into the chamber 62. A distinct tap 86 communicates with tap 88 and leads to chamber 64. Tap 82 is positioned such that it is associated with a modulated chamber such as chamber 32 while tap 86 is associated with a chamber, such as chamber 34, which would not be modulated. During full capacity operation, both taps 82 and 86 are provided with pressurized fluid which is directed into the chambers 62 and 64. Thus, a full back pressure force is provided. However, when the compressor is operating in reduced capacity, then there is no pressurized gas force in the chamber which is exposed to the tap 82 and there will be no corresponding discharge pressure gas tapped into the chamber 62. The sole back pressure force will be from chamber 64 and tap 86.

It should be understood that when this Application speaks of there being no compression in the restricted chambers, or no force from the blocked back pressure chambers, this is an over-simplification. In fact, there will be some amount of fluid in the restricted chambers due to the breather tap. However, the amount will be quite small compared to the normal amount compressed in the other compression chambers. The same is true of the force from the back pressure chamber. There will be some force existing in even the back pressure chamber not supplied with the normal amount of pressurized fluid. However, the amount and forces will be very small. The present invention will still achieve modulated operation, and positive operation of the scroll compressor during modulated operation.

Preferred embodiments of these inventions have been disclosed, however, a worker of ordinary skill in the art would recognize that certain modifications come within the scope of this invention. For that reason, the following claims should be studied to determine the true scope and content of this invention.

What is claimed is:

1. A scroll compressor comprising:

a first scroll having a base and a generally spiral wrap extending from said base;

a second scroll having a base and a generally spiral wrap interfitting with said spiral wrap of said first scroll to define compression chambers, said compression chambers being defined both on a radially inner and a radially outer face of said first scroll, said first scroll being driven to orbit relative to said second scroll;

a restrictor to selectively restrict the supply of refrigerant to at least some of said compression chambers to reduce the mass of refrigerant being compressed; and a back pressure chamber defined behind said base of one of said first and second scrolls, the force from said back pressure chamber being reduced when said scroll compressor is in a restricted mode.

2. A scroll compressor as recited in claim 1, wherein there are at least two back pressure chambers.

3. A scroll compressor as recited in claim 2, wherein one of said at least two back pressure chambers being closed off when said compressor volume is restricted.

4. A scroll compressor as recited in claim 3, wherein said two chambers are defined by three annular seals.

5. A scroll compressor as recited in claim 2, wherein there are at least two distinct taps from said compression chambers into said two back pressure chambers, with one of said taps being associated with a compression chamber which is blocked during restricted operation such that pressurized refrigerant is not directed into said back pressure chamber associated with said one tap.

6. A scroll compressor as recited in claim 1, wherein said back pressure chamber is defined on an opposed side of said base of said one of said first and second scrolls from said wrap.

7. A scroll compressor having capacity modulation comprising:

a first scroll having a wrap and a generally spiral wrap extending from said wrap;

a second scroll having a base and a generally spiral wrap extending from said base, said wrap of said second scroll interfitting with said wrap of said first scroll to define a plurality of compression chambers, said first scroll being driven to orbit relative to said second scroll; and a back pressure chamber defined behind said base of one of said first and second scrolls, said back pressure chamber having a reduced force when said scroll compressor is being operated in a reduced capacity mode.

8. A scroll compressor as recited in claim 7, wherein said back pressure chamber includes two distinct chambers.

9. A scroll compressor as recited in claim 8, wherein three annular seals define said two chambers.

10. A scroll compressor as recited in claim 8, wherein a moveable member selectively closes off a tap to at least one of said two chambers to provide said reduced force in said back pressure chamber.

11. A scroll compressor as recited in claim 10, wherein said moveable member is a vane moveable within a supply port which supplies pressurized refrigerant to said tap.

12. A scroll compressor as recited in claim 8, wherein separate taps are provided to each of said two back pressure chambers, with said taps extending into distinct compression chambers.

13. A scroll compressor as recited in claim 12, wherein said compression chambers include at least one compression chamber which is not compressing a normal amount of fluid during reduced capacity operation such that a pressurized gas is not supplied to an associated back pressure chamber during reduced capacity operation.

14. A scroll compressor as recited in claim 7, wherein said back pressure chamber is defined behind said first scroll.

15. A scroll compressor as recited in claim 7, wherein said back pressure chamber is defined on an opposed side of said base of said one of said first and second scrolls from said wrap.

16. A method of operating a scroll compressor comprising the steps of:

(1) providing an orbiting scroll and a non-orbiting scroll, and driving said orbiting scroll relative to said non-orbiting scroll;

(2) supplying a refrigerant to be compressed to chambers between said orbiting and non-orbiting scroll wraps;

(3) reducing flow of refrigerant to certain of said chambers when a reduced capacity is desired; and (4) reducing a back pressure force when operating in reduced mode under step (3).

17. A method as set forth in claim 16, wherein said back pressure force is defined behind a base of one of said orbiting and non-orbiting scrolls, behind being defined as an opposed side of said base than a direction in which a wrap extends from said base.

* * * * *